US011117044B1

(12) United States Patent
Chen

(10) Patent No.: US 11,117,044 B1
(45) Date of Patent: Sep. 14, 2021

(54) RAMP SYSTEM FOR SPORTS

(71) Applicant: Wang-Chuan Chen, Taichung (TW)

(72) Inventor: Wang-Chuan Chen, Taichung (TW)

( * ) Notice: Subject to any disclaimer, the term of this patent is extended or adjusted under 35 U.S.C. 154(b) by 0 days.

(21) Appl. No.: 16/995,111

(22) Filed: Aug. 17, 2020

(30) Foreign Application Priority Data

Jul. 27, 2020 (CN) ..... 202021509139.6

(51) Int. Cl.
*A63C 19/10* (2006.01)
*B65G 69/30* (2006.01)

(52) U.S. Cl.
CPC ..... *A63C 19/10* (2013.01); *A63C 2201/02* (2013.01)

(58) Field of Classification Search
CPC ..... A69C 19/00; A69C 19/02; B65G 69/28; B65G 69/30; A63C 2201/02
USPC ..... 472/88–90; 14/69.5
See application file for complete search history.

(56) References Cited

U.S. PATENT DOCUMENTS 10,166,459 B1 1/2019 Chen
2002/0144364 A1* 10/2002 Anderson ..... E04F 11/002 14/69.5
2004/0078907 A1* 4/2004 Rieber ..... A63C 19/10 14/69.5
2008/0066241 A1* 3/2008 Evans ..... B61B 3/00 14/69.5
2013/0055511 A1* 3/2013 McGivern ..... E04F 11/002 14/69.5
2014/0271100 A1* 9/2014 Giemza ..... B65G 69/30 414/813
2015/0321075 A1* 11/2015 Fuhrmeister ..... A63C 19/10 472/89

* cited by examiner

*Primary Examiner* — Kien T Nguyen
(74) *Attorney, Agent, or Firm* — Karin L. Williams; Alan D. Kamrath; Mayer & Williams PC

(57) ABSTRACT

A ramp system includes a ramp unit, a sliding rod, and a connecting unit. The ramp unit includes a first ramp having an upper edge and a lower edge spaced from the upper edge in a vertical direction. The sliding rod includes a sliding portion, a first leg, and a second leg. The sliding portion extends from an end of the sliding rod to another end of the sliding rod. The first leg and the second leg are connected to two different locations of the sliding portion. The connecting unit includes a column and a connecting member. The column is connected to the lower edge of the first ramp. The connecting member is connected to the upper edge of the first ramp. The connecting member includes a coupling ring mounted around the first leg.

6 Claims, 4 Drawing Sheets

RAMP SYSTEM FOR SPORTS

BACKGROUND OF THE INVENTION

The present invention relates to a ramp system and, more particularly, to a ramp system for sports.

China Patent Application No. 201721763469.6 discloses a ramp system including a first ramp and a first connecting piece. A first slope is disposed on an end of first ramp, and a second slope is disposed on the other end of the first ramp. A first connecting portion is disposed on a top portion of the first ramp and is located between the first and second slopes of the first ramp. A bottom portion of the first connecting piece includes a first connecting portion and a second connecting portion. The first connecting portion of the first connecting piece is releasably connected to the first connecting portion of the first ramp. The second connecting portion of the first connecting piece is releasably connected to another ramp or an ornamental terrain article.

However, the above modular ramp system is comprised of boards and ramps and, thus, can only form slopes and planes. This terrain design is too monotonous and is less challenging to extreme sportspersons.

BRIEF SUMMARY OF THE INVENTION

An objective of the present invention is to provide a ramp system including a ramp unit, a sliding rod, and a connecting unit. The ramp unit includes a first ramp having an upper edge and a lower edge spaced from the upper edge in a vertical direction. The sliding rod includes a sliding portion, a first leg, and a second leg. The sliding portion extends from an end of the sliding rod to another end of the sliding rod. The first leg and the second leg are connected to two different locations of the sliding portion. The connecting unit includes a column and a connecting member. The column is connected to the lower edge of the first ramp. The connecting member is connected to the upper edge of the first ramp. The connecting member includes a coupling ring mounted around the first leg.

In an example, the connecting member includes an upper board, a lateral board, and a protrusion. The upper board is connected to the upper edge of the first ramp. The lateral board is connected to the upper board and is adjacent to the column. The protrusion is connected to a side of the lateral board opposite to the column. The coupling ring is connected to the protrusion.

In an example, the sliding rod includes a first leg support and a second leg support. The first leg support includes a first bottom board. A first connecting rod is connected to a side of the first bottom board. The first leg is tubular and mounted around the first connecting rod. The second leg support includes a second bottom board. A second connecting rod is connected to a side of the second bottom board. The second leg is tubular and mounted around the second connecting rod.

In an example, the first ramp includes a first top face disposed on the upper edge thereof. The first top face is a planar face extending horizontally. The ramp unit further includes a second ramp connected to the first ramp. The second ramp includes a second top face disposed on an upper edge thereof. The second top face is planar. A height of an end of the second top face opposite to the first ramp is smaller than a height of another end of the second top face adjacent to the first ramp.

In an example, the ramp unit further includes a third ramp. The second ramp and the third ramp are connected to two opposite ends of the first ramp. The third ramp includes a third top face on an upper edge thereof The third top face is planar. A height of an end of the third top face opposite to the first ramp is smaller than a height of another end of the third top face adjacent to the first ramp.

In an example, the ramp unit further includes a fourth ramp connected to a side of the first ramp opposite to the sliding rod. The fourth ramp includes a fourth top face on an upper edge thereof. A height of an end of the fourth top face opposite to the first ramp is smaller than a height of another end of the fourth top face adjacent to the first ramp.

The present invention will become clearer in light of the following detailed description of illustrative embodiments of this invention described in connection with the drawings.

DETAILED DESCRIPTION OF THE INVENTION

Figure 1:
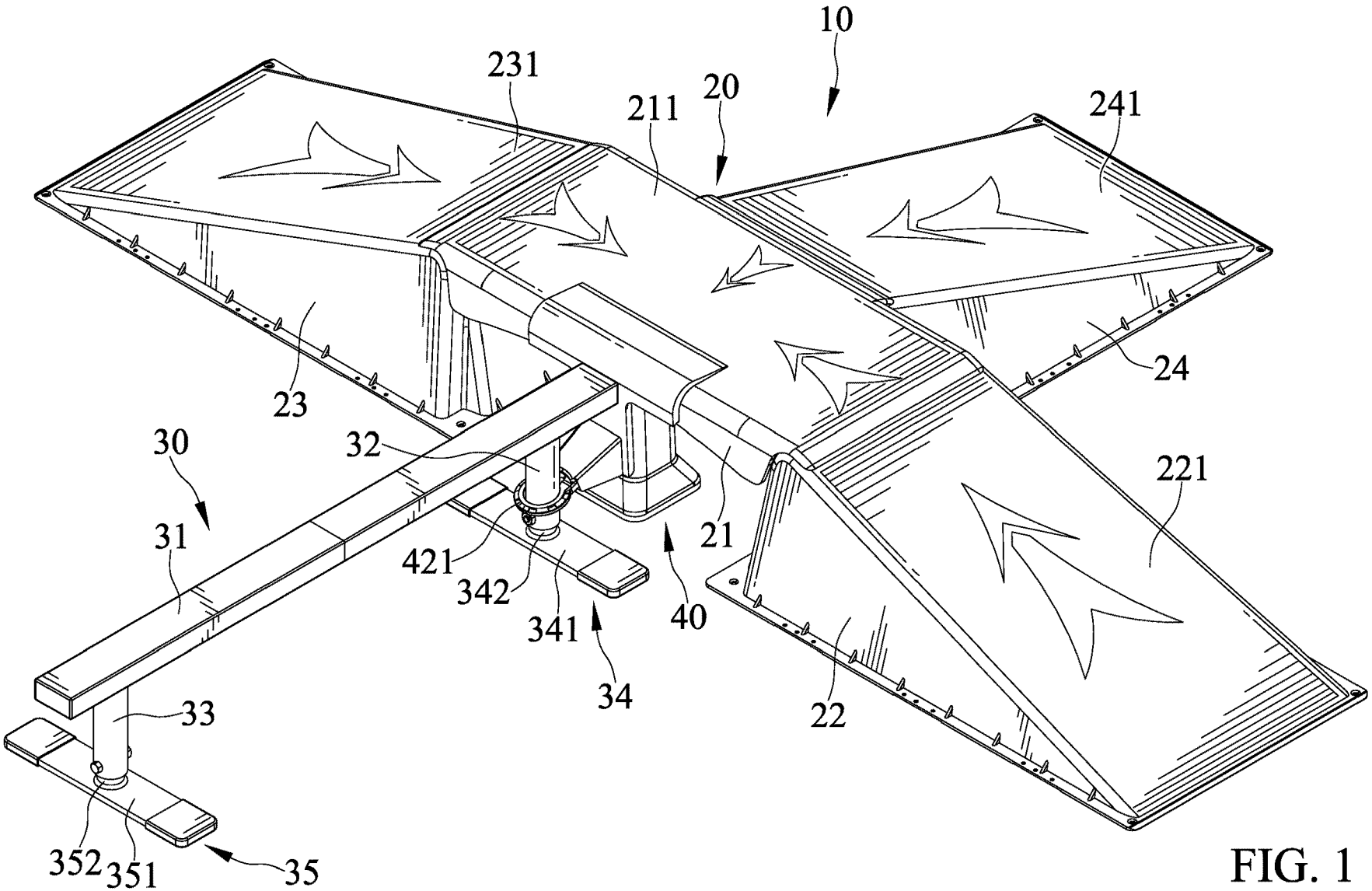
FIG. 1 is a perspective view of a ramp system for sports of an embodiment according to the present invention.
Figure 2:
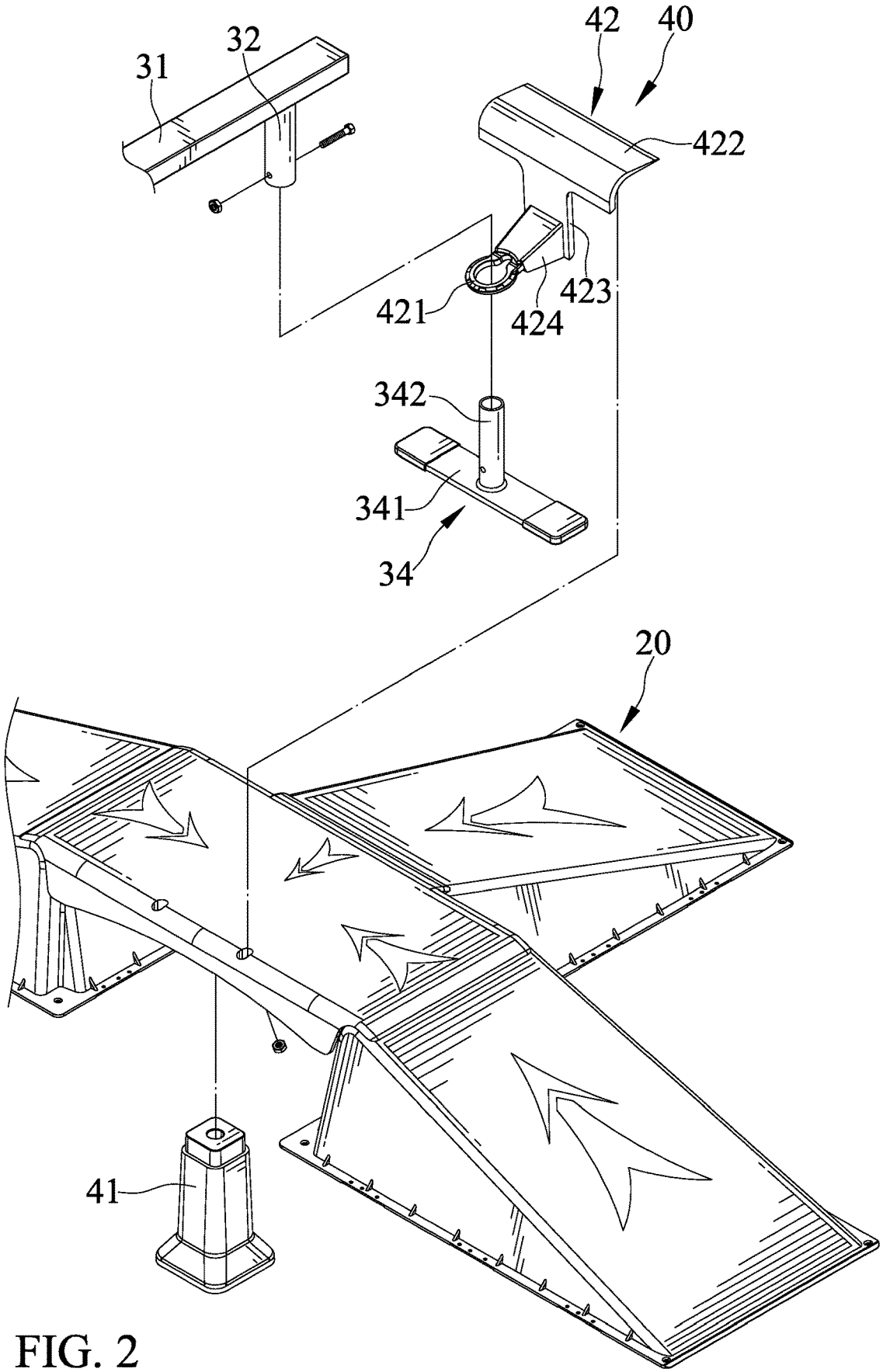
FIG. 2 is a partial, exploded, perspective view of the ramp system of FIG. 1.
Figure 3:
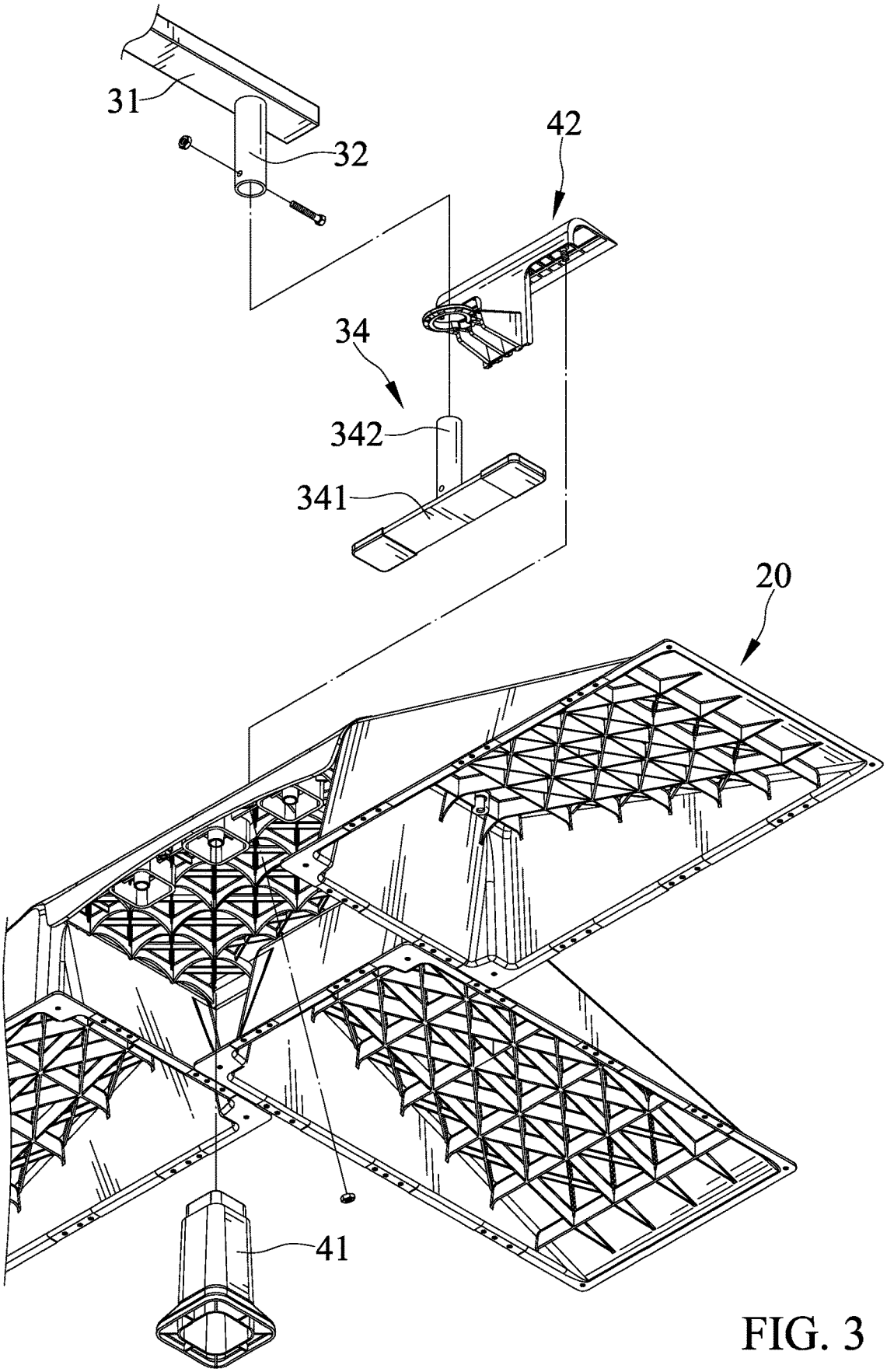
FIG. 3 is another partial, exploded, perspective view of the ramp system of FIG. 1.
Figure 4:
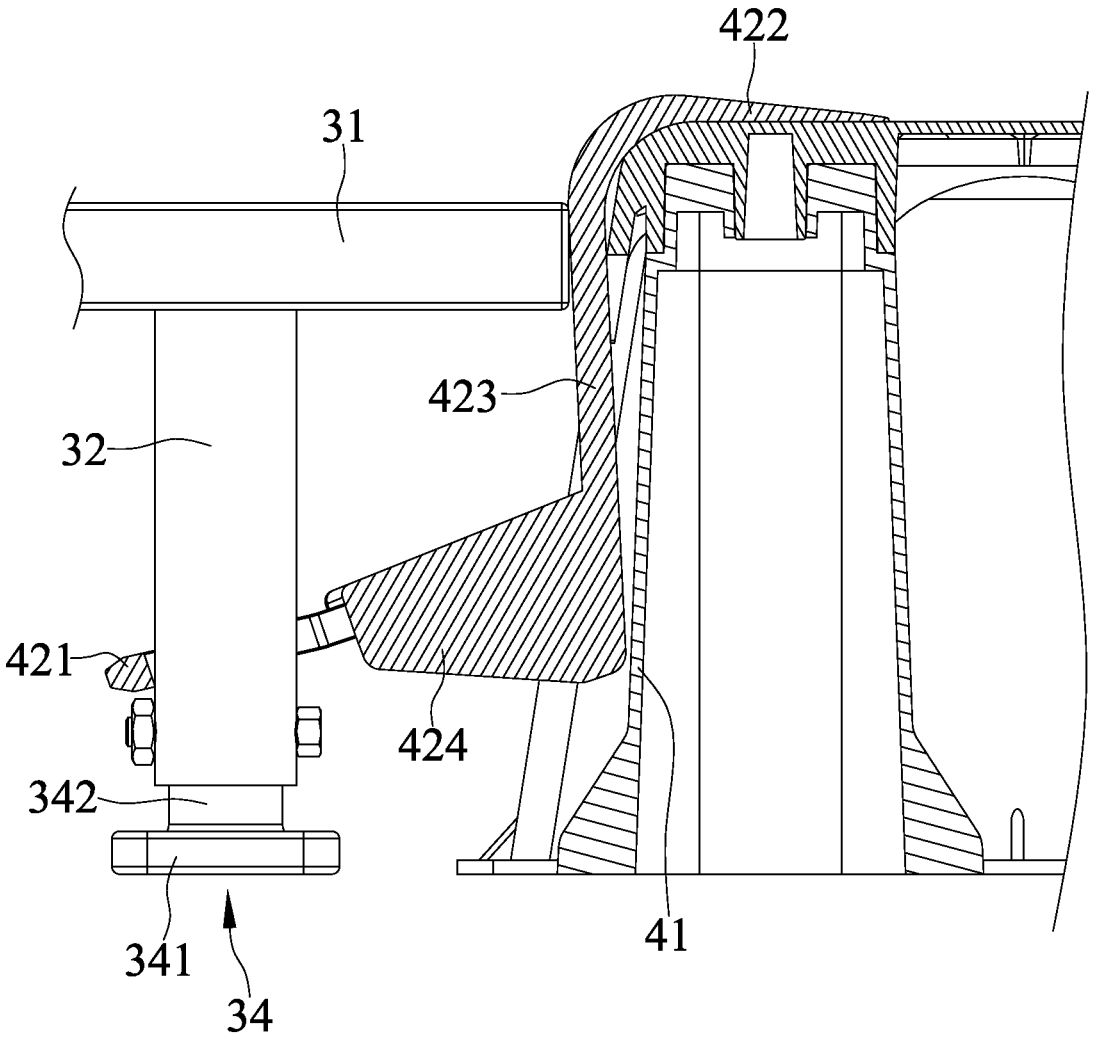
FIG. 4 is a partial, cross sectional view of the ramp system of FIG. 1.

With reference to FIGS. 1-4, a ramp system 10 for sports of an embodiment according to the present invention includes a ramp unit 20, a sliding rod 30, and a connecting unit 40. The ramp unit 20 includes a first ramp 21 having an upper edge and a lower edge spaced from the upper edge in a vertical direction.

The sliding rod 30 includes a sliding portion 31, a first leg 32, and a second leg 33. The sliding portion 31 extends from an end of the sliding rod 30 to another end of the sliding rod 30. The first leg 32 and the second leg 33 are connected to two different locations of the sliding portion 31.

The connecting unit 40 includes a column 41 and a connecting member 42. The column 41 is connected to the lower edge of the first ramp 21. The connecting member 42 is connected to the upper edge of the first ramp 21. The connecting member 42 includes a coupling ring 421 mounted around the first leg 32.

The connecting member 42 includes an upper board 422, a lateral board 423, and a protrusion 424. The upper board 422 is connected to the upper edge of the first ramp 21. The lateral board 423 is connected to the upper board 422 and is adjacent to the column 41. The protrusion 424 is connected to a side of the lateral board 423 opposite to the column 41. The coupling ring 421 is connected to the protrusion 424.

The sliding rod 30 includes a first leg support 34 and a second leg support 35. The first leg support 34 includes a first bottom board 341 configured to be fixed to a road surface or the like. A first connecting rod 342 is connected to a side of the first bottom board 341. The first leg 32 is tubular and mounted around the first connecting rod 342. The second leg support 35 includes a second bottom board 351 configured to be fixed to the road surface or the like. A second connecting rod 352 is connected to a side of the second bottom board 351. The second leg 33 is tubular and mounted around the second connecting rod 352.

The first ramp 21 includes a first top face 211 disposed on the upper edge thereof The first top face 211 is a planar face extending horizontally. The ramp unit 20 further includes a second ramp 22 connected to the first ramp 21. The second ramp 22 includes a second top face disposed on an upper edge thereof The second top face 221 is planar. A height of an end of the second top face 221 opposite to the first ramp 21 is smaller than a height of another end of the second top face 221 adjacent to the first ramp 21. The ramp unit 20 further includes a fourth ramp 24 connected to a side of the first ramp 21 opposite to the sliding rod 30. The fourth ramp 24 includes a fourth top face 241 on an upper edge thereof A height of an end of the fourth top face 241 opposite to the first ramp 21 is smaller than a height of another end of the fourth top face 241 adjacent to the first ramp 21.

The ramp unit 20 further includes a third ramp 23. The second ramp 22 and the third ramp 23 are connected to two opposite ends of the first ramp 21. The third ramp 23 includes a third top face 231 on an upper edge thereof The third top face 231 is planar. A height of an end of the third top face 231 opposite to the first ramp 21 is smaller than a height of another end of the third top face 231 adjacent to the first ramp 21.

The ramp system 10 according to the present invention provides a versatile skating environment for sportspersons through the above structure. Furthermore, the sliding rod 30 connected to the road surface provides excellent safety. The sportspersons, such as skateboarders, can surf on the first, second, and third top faces 221, 231, and 241 and the sliding portion 31 of the sliding rod 30, providing various surfing styles.

Although specific embodiments have been illustrated and described, numerous modifications and variations are still possible without departing from the scope of the invention. The scope of the invention is limited by the accompanying claims.

The invention claimed is:

1. A ramp system for sports, comprising:

a ramp unit including a first ramp having an upper edge and a lower edge spaced from the upper edge in a vertical direction;

a sliding rod including a sliding portion, a first leg, and a second leg, wherein the sliding portion extends from an end of the sliding rod to another end of the sliding rod, and wherein the first leg and the second leg are connected to two different locations of the sliding portion; and a connecting unit including a column and a connecting member, wherein the column is connected to the lower edge of the first ramp, wherein the connecting member is connected to the upper edge of the first ramp, and wherein the connecting member includes a coupling ring mounted around the first leg.

2. The ramp system for sports as claimed in claim 1, wherein the connecting member includes an upper board, a lateral board, and a protrusion, wherein the upper board is connected to the upper edge of the first ramp, wherein the lateral board is connected to the upper board and is adjacent to the column, wherein the protrusion is connected to a side of the lateral board opposite to the column, and wherein the coupling ring is connected to the protrusion.

3. The ramp system for sports as claimed in claim 2, wherein the sliding rod includes a first leg support and a second leg support, wherein the first leg support includes a first bottom board, wherein a first connecting rod is connected to a side of the first bottom board, wherein the first leg is tubular and mounted around the first connecting rod, wherein the second leg support includes a second bottom board, wherein a second connecting rod is connected to a side of the second bottom board, and wherein the second leg is tubular and mounted around the second connecting rod.

4. The ramp system for sports as claimed in claim 3, wherein the first ramp includes a first top face disposed on the upper edge thereof, wherein the first top face is a planar face extending horizontally, wherein the ramp unit further includes a second ramp connected to the first ramp, wherein the second ramp includes a second top face disposed on an upper edge thereof, wherein the second top face is planar, and wherein a height of an end of the second top face opposite to the first ramp is smaller than a height of another end of the second top face adjacent to the first ramp.

5. The ramp system for sports as claimed in claim 4, wherein the ramp unit further includes a third ramp, wherein the second ramp and the third ramp are connected to two opposite ends of the first ramp, wherein the third ramp includes a third top face on an upper edge thereof, wherein the third top face is planar, and wherein a height of an end of the third top face opposite to the first ramp is smaller than a height of another end of the third top face adjacent to the first ramp.

6. The ramp system for sports as claimed in claim 5, wherein the ramp unit further includes a fourth ramp connected to a side of the first ramp opposite to the sliding rod, wherein the fourth ramp includes a fourth top face on an upper edge thereof, and wherein a height of an end of the fourth top face opposite to the first ramp is smaller than a height of another end of the fourth top face adjacent to the first ramp.

* * * * *